United States Patent [19]

Owsianny et al.

[11] Patent Number: 4,836,746

[45] Date of Patent: Jun. 6, 1989

[54] AXIAL FLOW ENGINE GUIDE VANE ADJUSTING DEVICE

[75] Inventors: Emund Owsianny, Oberhausen; Wilfried Wengorz, Castrop-Rauxel; Emil Aschenbruck, Duisburg, all of Fed. Rep. of Germany

[73] Assignee: Man Gutehoffnungshuette GmbH, Fed. Rep. of Germany

[21] Appl. No.: 176,035

[22] Filed: Mar. 31, 1988

[30] Foreign Application Priority Data

Apr. 3, 1987 [DE] Fed. Rep. of Germany ..... 3711224

[51] Int. Cl.[4] ..... F04D 29/36

[52] U.S. Cl. ..... 415/160; 415/149.2

[58] Field of Search ..... 415/149 R, 150, 151, 415/159, 160, 161

[56] References Cited

U.S. PATENT DOCUMENTS

| | | | |
|---|---|---|---|
| 2,671,634 | 3/1954 | Morley | 415/149 R X |
| 2,936,108 | 5/1960 | Balcom et al. | 415/149 R X |
| 3,013,771 | 12/1961 | Henny | 415/160 |
| 3,074,689 | 1/1963 | Chapman | 415/160 X |
| 3,303,992 | 2/1967 | Johnson | 415/160 X |
| 3,455,331 | 7/1969 | Baumann et al. | 415/160 X |
| 3,538,579 | 11/1970 | Sprenger | 415/160 X |
| 3,695,777 | 10/1972 | Westphal et al. | 415/160 X |
| 3,719,427 | 3/1973 | Davis | 415/160 X |
| 4,618,311 | 10/1986 | Miura et al. | 415/150 X |

FOREIGN PATENT DOCUMENTS

| | | |
|---|---|---|
| 3125639 | 1/1983 | Fed. Rep. of Germany . |
| 3225639 | 8/1983 | Fed. Rep. of Germany . |
| 3519747 | 6/1985 | Fed. Rep. of Germany . |

*Primary Examiner*—Robert E. Garrett
*Assistant Examiner*—Joseph M. Pitko
*Attorney, Agent, or Firm*—McGlew & Tuttle

[57] ABSTRACT

The shafts of guide vanes of an axial-flow engine, in particular, a combustion turbine, are supported angle-adjustably in an annular guide vane carrier and are spring-loaded and vibration-damped in their axis directions. An adjustment ring concentric to the flow channel is supported play-free and with low-friction engagement in a groove of a carrier ring by radial and axial rolls. Levers wedged on the guide vane shafts are pivoted by pins in a cylinder bolt, which, in turn, are supported rotatably and displaceably in laterally open bores of the adjustment ring and axis-parallel to it. This permits a largely play-free transfer of the adjustment motion onto the guide vane shafts without point or line contact. The guide vane carrier closes off the groove of the carrier ring so, that the entire mechanism is protected against dust.

6 Claims, 3 Drawing Sheets

AXIAL FLOW ENGINE GUIDE VANE ADJUSTING DEVICE

BACKGROUND OF THE INVENTION

1. Field of the Invention

The invention relates, in general, to rotary engines and, in particular, to a new and useful adjustment device for the guide vanes of an axial-flow engine.

A similar adjustment of this nature is known from German Pat. No. 35 19 747. It permits changing the setting angle of the guide vanes during operation of the fluid flow engine, in particular of a turbo compressor and, in this way, adapting the response of the engine to varying operating conditions such as, for example, partial and full load, and to reduce losses of the degree of effectiveness.

In the prior known adjustment device, the adjustment ring is connected to the levers of the guide vanes through simple hinge bolts and is carried to them, hence, the ring is not guided separately on the housing. The articulation with the hinge bolts must have sufficient play, so that the adjustment motions, in which the adjustment ring and the levers rotate in different planes, is possible. The unavoidable heat expansion also presupposes sufficient play in the articulations.

During operation very strong forces act upon the guide vanes of a fluid flow engine. As far as they act perpendicular to the axis of the guide vane or parallel to it, they must be absorbed by the bearing of the guide vane shaft in the guide vane carrier. Additionally, however, strong torque occurs around the axis of the guide vane, which is transmitted over the levers to the adjustment ring. In this process, through the play in the articulation and through lacking guidance of the adjustment ring strong vibrations can be set up, which lead to losses of the degree of effectiveness and the operating life of the guide vane.

There are also adjustment devices for guide vanes known, in which the guide vanes are articulated through levers with an adjustment sleeve slidable in the axial direction, as, for example, according to German Pat. No. 31 25 639. Axially displaceable adjustment sleeves have the disadvantage that adjacent vane rings can only be adjusted in common, not, however, individually. Also, with respect to bearing play and sensitivity to vibration stresses similar problems occur. The known adjustment devices are provided in the low temperature range, in particular for compression, or the compression stage of open gas turbines. An adjustment device, which also can be satisfactorily applied in the high temperature range, in particular in closed gar turbines, is not known.

SUMMARY OF THE INVENTION

The invention is based on the task of improving an adjustment device of the kind mentioned at the beginning in such a way that compact construction is accomplished, which has easy motion and is largely protected against outside influences. The device can also be laid out for application in the high temperature range and the forces acting upon the guide vanes are largely absorbed without play, so that vibrations do not occur. However, the adjustment motions can take pace with easy action and with relatively little wear and tear.

Accordingly, it is an object of the invention to provide an adjustment device for the guide means of an axial flow engine which comprises a carrier ring which has a radially inner face with a radially extending carrier ring recess and having a rotation axis about which an adjustment ring is also rotatably supported in the recess, and with an annular guide vane carrier being rotatable in the carrier ring recess about the rotation axis also and which includes a plurality of axial flow vanes having shaft portions rotatably mounted in the guide vane carrier ring each of which has a lever connected thereto which is actuated by a control bolt which is pivotally rotated in the adjustment ring and connected to the lever arm of each shaft of each vane to cause rotation of the shaft with the lever arm during movement of the adjustment ring relative to the carrier ring and the annular guide vane carrier.

A further object of the invention is to provide an adjustment device for the guide vanes of axial flow engines which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENTS

Figure 1:
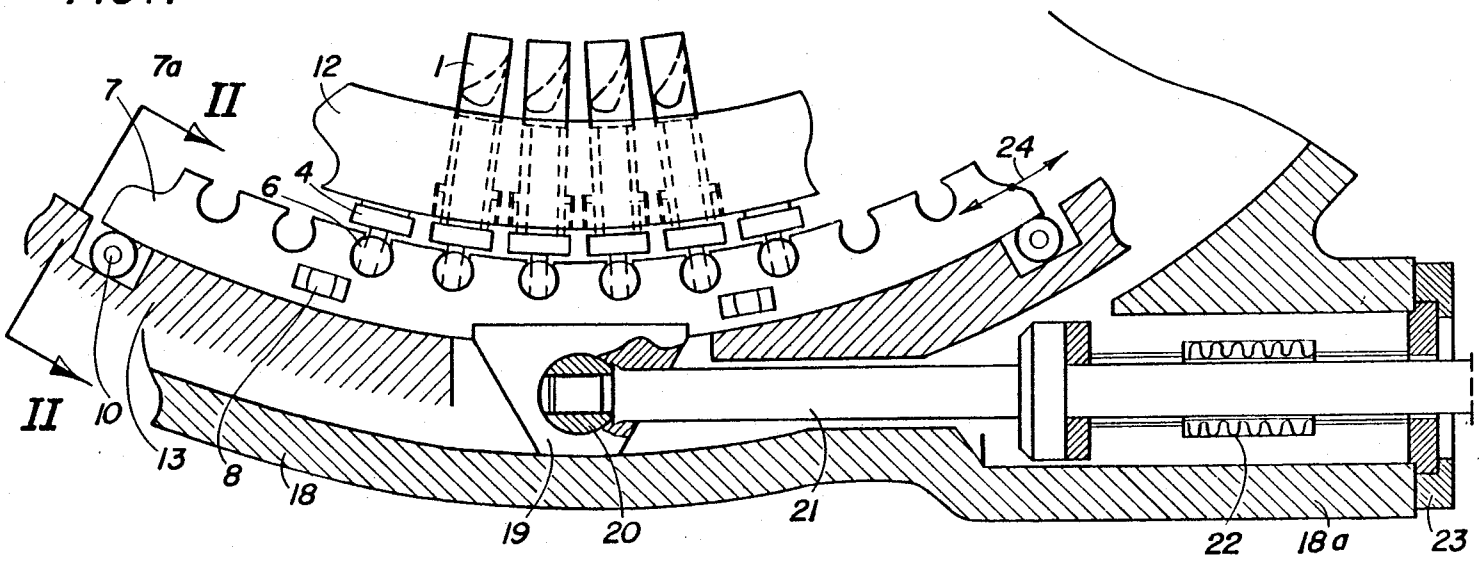
FIG. 1 is an axis-perpendicular section through part of the guide vane ring of a fluid engine with associated adjustment device constructed in accordance with the invention.

Referring to the drawings, in particular, the invention embodied therein comprises an adjustment device for guide vanes 1 of an axial flow engine which includes a carrier ring 13 which has a radially inner face with a radially extending carrier ring recess which has a central axis. An adjustment ring 7 is rotatably supported in the carrier ring recess for rotation about the carrier ring central axis and an annular guide vane carrier 12 is positioned in the carrier ring recess also. A plurality of axial flow guide vanes have shaft portions 1*a* which are rotatably mounted in the annular guide vane carrier 12. A lever 4 is connected to each shaft portion 1*a* and it has an outer end in which a bolt 5 is rotatable over a cylinder bolt control element 6 which is rotatably supported in the adjustment ring 7.

Figure 2:
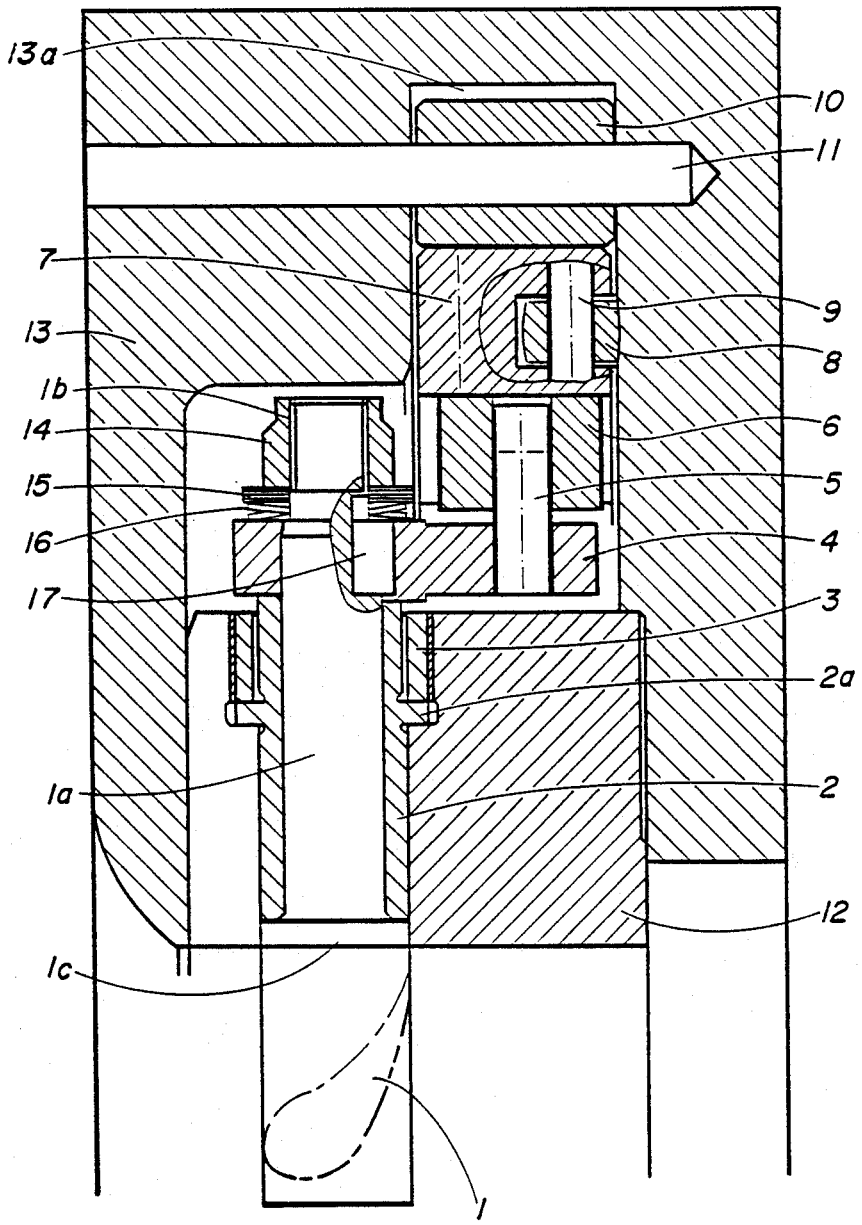
FIG. 2 is an enlarged scale sectional view taken along line II—II of FIG. 1.
Figure 3:
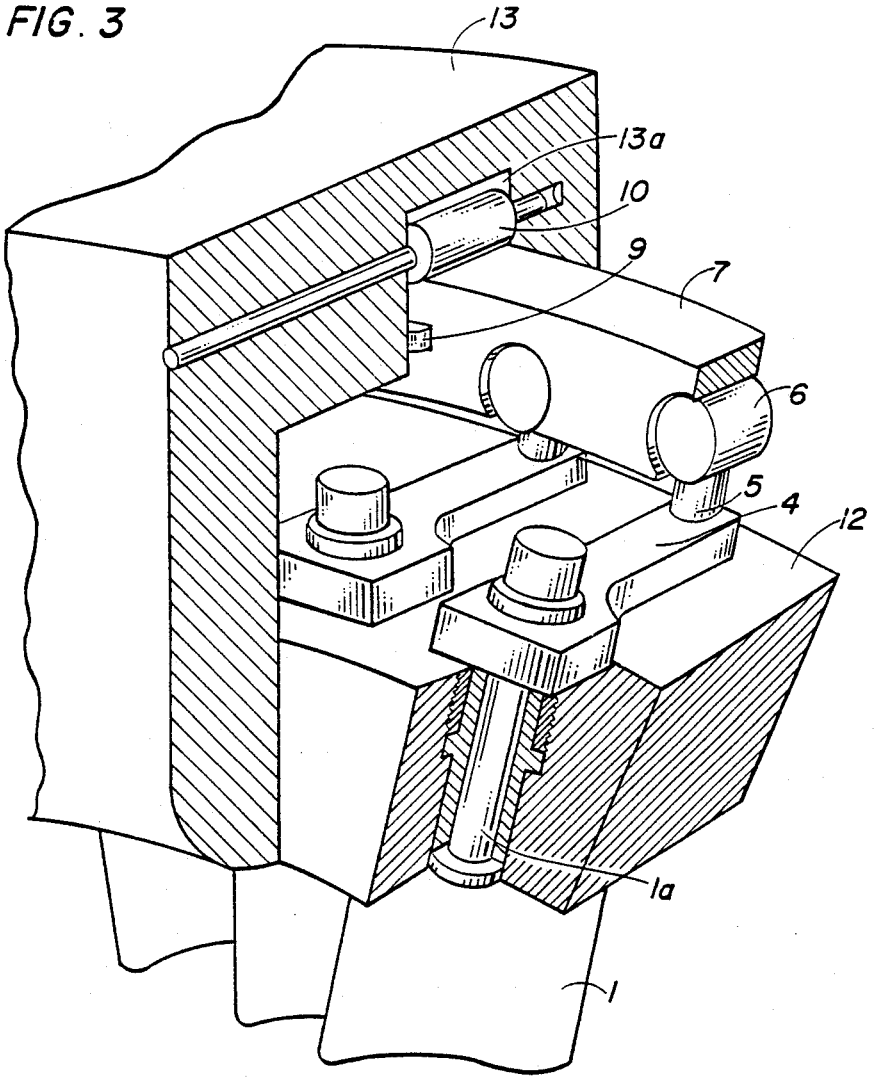
FIG. 3 is a perspective view of the adjustment device.

The guide vanes 1 of a vane ring of the engine have shafts 1*a*, which are pivoted in radial bearing bores of the annular guide vane carrier 12 and specifically in bearing bushes 2, which have an outer flange 2*a* and are fixed in the bearing bore with a screwed-in ring nut 3. A lever 5 is torsion-tight at the outside of the guide vane carrier 12 on the extended shaft 1*a* of the guide vane. The lever 4 is braced against the end of the bearing bush 2 projecting beyond the guide vane carrier 12 by a spring cup 16 which pushes onto the topside of the lever 4, through a disk 15 covered by a crown nut 14 which is screwed onto a threaded end 1*b* of shaft 1*a*. The cup spring 16 exerts an initial stressing force onto the shaft 1*a* directed upward in FIG. 2, through which a flange 1*c* on the shaft 1*a* is pressed against the lower front face of the bearing bush 2. Thereby, shaft 1*a* is clamped in the bearing bush 2 axially play-free and elastic against heat expansion, and vibration damping.

The guide vane carrier 12 is set dust-free into an annular recess of a carrier ring 13. In a groove 13*a* of the carrier ring 13, an adjustment ring 7 is supported rotatably. Guidance in the radial direction takes place via radial rolls 10, which are arranged in groove 13*a* and supported with bearing bolts 11 on the carrier ring. Guidance in the axial direction takes place through axial rolls 8, which are supported on the adjustment ring 7 with bearing bolts 9. The preferentially curved peripheral area of the rolls 8 project slightly beyond the front face of the adjustment ring 7, and they rest against the axial area of contact of a groove 13*a* of the carrier ring. In order to set in adjustment ring 7 and guide vane carrier, the carrier ring 13 is divided into two halves in a suitable axial plane and they are fastened to each other by fastening means (not shown).

The adjustment ring has, corresponding to the guide vane number, a number of cylindrical bores 7*a*, which are open toward the inner peripheral area of the adjustment ring 7. It is rotatably and axially displaceable cylinder bolts 6 are supported. Each cylinder bolt 6 has an axis-perpendicular bore, in which a pin 5 is rotatably supported axis-parallel to the shaft 1*a* of the guide vane, the pin 5 being connected with lever 4.

As can be seen in FIG. 1, on the adjustment ring 7, an extension 19 is provided which projects outward through a recess of carrier ring 13 and which has an adjustable spindle 21 which engages with a journal bearing 20. This is led outside through an entrance 18*a* of the external housing 18 of the flow engine, gas and dust-tight sealing taking place with an elastic bellows 22, which is fastened with a flange 23 on the lead-through socket. On the outer end of the adjustment spindle 21, not further shown, any manually or motor-actuatable adjustment drive can attach, in order to move the spindle 21 in its axial direction and in so doing rotate the adjustment ring in its circumferential direction corresponding to arrow 24.

When rotating the adjustment ring 7 in the circumferential direction through the cylinder bolts 6 and pins 5, the ends of the levers 4 are taken along, so that they rotate with respect to the axis of the guide vane. Since the levers 4 are connected torsion-tight with shafts 1*a* of the guide vanes, through this motion the guide vanes are also rotated around their axes. The position changes of pins 5 occurring by necessity relative to the center plane and radial direction of the adjustment ring 7 are compensated by the rotationability and axial displaceability of the cylinder bolts 6. This insures that jamming of any kind is avoided even though, at the bearing areas of the different movable parts which are mobile relative to each other, no bearing play is required and guidance of the guide vanes with the adjustment rings takes place form-fittingly, play-free, and exclusively through area contact without point or line contact.

The entire adjustment mechanism is encapsulated dust-tight in the space enclosed by the carrier ring 13 and the guide vane carrier 12 set in it.

The entire adjustment device has a compact structure, which does not take up significantly more space than the guide vane shaft ring itself. It is, therefore, readily possible to equip even axially closely adjacent guide vane rings with such an adjustment device each.

Given an appropriate choice of materials for the parts in slide contact with each other, the entire adjustment device is lubricant- and hence also maintenance-free. For the guide vane shaft 1, the adjustment ring 7, and the pin 5 special steels can preferentially be applied such as, for example:

X2 Cr Mo v 12.1
X5 Ni Cr Ti 2615
X8 Cr Ni Mo Nb 1810
X8 Cr Ni Mo B Nb 1810 and the friction surfaces of these constructional parts can additionally be surface-hardened, while for bearing bush 2 and a cylinder bolt 6 bearing materials with good slide properties such as, for example stellite 21, Tribaloy T 400, or steels such as GGG-Ni Cr Nb 202 or GGG 40 are used.

The setting motion generated by the externally placed (not shown) setting drive over the adjustment spindle 21 is sealed gas-tight, barrier gas- and maintenance-free and introduced into the interior of the engine.

The entire adjustment device is designed due to its compact construction so that it is also suitable for retrofitting of already present machinery.

The material combination choice from among the previously mentioned preferred materials, can take place considering the operating temperatures of the particular application area to be expected, with the mentioned materials being suitable, in particular, for application under high temperatures. Further, for high-temperature application, the adjustment device according to the invention has the following advantageous features. The device according to the invention has no point or line contact of any kind between the motion-transmitting parts, but exclusively area contact between cylinder surfaces. Through this in connection with a temperature-related material selection, a defined play quality over an external temperature range and also over long operating times can be maintained. Point or line contact would lead, per force, to play enlargement after longer operating time. The device according to the invention is, particularly with regard to the particularly critical vane rotation vibrations largely play-free and remains so within a large temperature range and during a long operating time. It is, therefore, especially suitable for application, for example, in the high temperature part of the combustion turbines, where the operating temperatures can be, for example, 600° C. and more.

During extreme temperature changes when starting up or shutting down particular changes of the bearing play of the guide vane bearing are unavoidable. The spring load provided according to the invention of the guide vane shaft results in an effective suppression respectively damping of potential flexural vibrations of the guide vane.

While a specific embodiment of the invention has been shown and described in detail to illustrate the application of the principals of the invention, it will be understood that the invention may be embodied otherwise without departing from such principles.

What is claimed is:

1. An adjustment device for the guide vanes of an axial flow engine, comprising a carrier ring having a radial inner face with a radially extending carrier ring recess and having a central axis, an adjustment ring rotatably supported in said carrier ring recess for rotation about said central axis, an annular guide vane carrier positioned in said carrier ring recess about said central axis, a plurality of axial flow guide vanes having shaft portions rotatably mounted in said annular guide vane carrier, a lever connected to each of said shaft portions for rotation therewith and having a lever arm extending outwardly therefrom, a control bolt for each lever rotatably mounted in said adjustment ring and connected to respective lever arms, and means to rotate said adjustment ring so that it is displaced circumferentially relative to said guide vane carrier to cause rotation of said lever arm with said guide vanes.

2. An adjustment device according to claim 1, further comprising roller means for supporting said adjustment ring relative to said carrier ring in an axial and radial direction.

3. An adjustment device according to claim 2, wherein said axially acting and radially acting roller means includes a bearing bolt mounted on said carrier means, said bearing bolt having an axial axis extending parallel to the central axis of said carrier ring and having a roll bearing against an outer circumference of said adjustment ring and said axially acting and radially acting roller means including a second roll rotatably mounted in said adjustment ring for rotating about a radial axis said second roll having a periphery bearing against a side periphery of said adjustment ring.

4. An adjustment device according to claim 1, wherein said control bolt comprises a cylinder member, said adjustment ring having a hollow cylinder portion receiving said cylinder member said cylinder member being rotatable about an axial axis, said control bolt having a connection bolt extending radially outwardly therefrom and rotatably engaged in said lever arm.

5. An adjustment device according to claim 1, including a bushing unit in said annular guide vane carrier for each vane rotatably supporting said vane shafts and having a radially outer threaded portion, a spring engaged over said threaded portion and bearing against said lever and a nut over the threaded portion and bearing against said spring to prestress it against said lever, said lever being engaged over said bushing unit.

6. An adjustment device according to claim 5, wherein said bearing bush includes a radially outwardly extending portion engaged in a bore of said annular guide vane carrier and a ring nut threaded into said bush and bearing against the outer portion to seat it in the groove of said guide vane carrier.

* * * * *

UNITED STATES PATENT AND TRADEMARK OFFICE

CERTIFICATE OF CORRECTION

PATENT NO. : 4,836,746

DATED : Jun. 6, 1989

INVENTOR(S) : Emund Owsianny, Wilfried Wengorz, Emil Aschenbruck

It is certified that error appears in the above-identified patent and that said Letters Patent is hereby corrected as shown below:

On the title page, item [73], "Man Gutehoffnungshuette GmbH" should be --MAN Gutehoffnungshutte GmbH--.

Signed and Sealed this

Twenty-ninth Day of May, 1990

*Attest:*

HARRY F. MANBECK, JR.

*Attesting Officer*

*Commissioner of Patents and Trademarks*